US005232218A

United States Patent [19]

Leps

[11] Patent Number: 5,232,218

[45] Date of Patent: Aug. 3, 1993

[54] PITCHING DEVICE INITIATOR MECHANISM

[76] Inventor: Thomas A. Leps, 34 Wolfe Grade, Kentfield, Calif. 94904

[21] Appl. No.: 670,048

[22] Filed: Mar. 15, 1991

[51] Int. Cl.[5] ..... A63B 69/00

[52] U.S. Cl. ..... 273/26 D

[58] Field of Search ..... 273/26 R, 26 D, 29 A, 273/201

[56] References Cited

U.S. PATENT DOCUMENTS

| | | | |
|---|---|---|---|
| 2,159,122 | 5/1939 | Armstrong | 273/201 |
| 2,955,823 | 10/1960 | Chamko | 273/26 D |
| 2,955,824 | 10/1960 | Chamko | 273/26 D |
| 4,132,214 | 1/1979 | Schurr et al. | 273/29 A |
| 4,194,648 | 3/1980 | Stanton | 273/201 |
| 4,955,606 | 9/1990 | Leps | 273/26 D |

FOREIGN PATENT DOCUMENTS

| | | | |
|---|---|---|---|
| 374052 | 5/1932 | United Kingdom | 273/201 |
| 1073545 | 6/1967 | United Kingdom | 273/201 |

*Primary Examiner*—Theatrice Brown

*Attorney, Agent, or Firm*—Larry D. Johnson

[57] ABSTRACT

A pitching device initiator mechanism provides an improved ball magazine and pitch initiator mechanism for a ball pitching device designed to selectively pitch a ball to a batter in a "soft-toss" drill. The mechanism includes an elongated ball capture cavity portion defining a ball magazine, a stop member positioned to capture and stabilize a single ball at a ready position, and a pivotable lever extending beneath the magazine, such that downward movement of one end of the lever extends a ball lifting element on the other end of the lever up into the capture cavity to lift the ball in the ready position over the stop member, to begin its roll down the ramps to the batter.

6 Claims, 2 Drawing Sheets

PITCHING DEVICE INITIATOR MECHANISM

BACKGROUND OF THE INVENTION

1. Field of the Invention

This invention relates generally to recreational apparatus, and more specifically to an improved ball pitching device as used in a soft-toss drill.

2. Description of the Prior Art

Baseball, softball and related sports are very popular, and numerous mechanical devices have been developed to assist and train players of the games. For example, several types of pitching or ball toss machines have been designed to enable a player to practice his batting skills without requiring another player to manually pitch the ball to him. Most such ball toss machines utilize a motor to sequentially throw the ball to the batter, or to release the ball down an inclined ramp and into the batter's "strike zone" for hitting. Such motorized devices are, by their very nature, relatively complex and expensive, and therefore not readily available to many consumers. More significantly, these devices require a power supply, usually in the form of an electrical extension cord extended to the nearest electrical outlet, or use of a portable electric generator, in order to operate. Thus, these devices are not always able to be used where desired, as in an open field or ballpark.

Other ball toss devices have been developed which are not motorized and do not require electrical power, but rather require manual operator release of a ball down a chute or tube towards an upwardly inclined extension, to gently "pitch" the ball to the batter. However, the release mechanisms on most known manual devices are often poorly positioned and/or difficult for the operator/batter to manipulate. Furthermore, due to the structural geometry and arrangement of their release mechanisms and chutes, most of these known manual devices deliver the ball to the batter's strike zone very quickly, so that the batter has little time to set up and prepare to swing. Thus, such devices are often not desirable as practice or teaching tools.

U.S. Pat. No. 4,955,606, by the applicant herein, describes a portable, collapsible structure designed to selectively pitch a ball to a batter in a "soft-toss" drill, as used to develop a batter's hand, wrist, and eye coordination. That device comprises a ball capture cavity portion bearing a lip member positioned to capture and stabilize a single ball at that level. An initial or "delay" ramp portion extends downward and rearward away from the ball capture cavity, and connects to a final or "acceleration" ramp portion which extends further downward but in the opposite longitudinal direction, forward in the direction of the ball capture cavity. The final ramp terminates in an upwardly-curved launch ramp portion extending towards the batter in the front of the apparatus, so that the launch ramp is generally beneath the ball capture cavity. The entire apparatus may be supported at any appropriate height by an adjustable-height stand.

That prior device additionally may include at least one ball magazine portion having a front end and a rear end, which is used for containing one or more balls to be pitched. The magazine is inclined generally downwardly from the rear to the front, and terminates at its front (i.e., lower) end into the ball capture cavity portion. Thus, the device can be used as a single-ball mechanism, or a repeatable ball pitching mechanism, as desired.

The ball pitching device taught by the U.S. Pat. No. 4,955,606 is used in the following manner: at least one ball is placed in the ball capture cavity (or the magazine, where the ball naturally rolls forward until it enters the ball capture cavity), so that it is (temporarily) held in place there by the lip member. The batter, standing in front of the apparatus in a batting stance (so that his feet are in the proper position when he hits the ball), reaches up to touch the ball with the barrel end of his bat through a bat access port opening in the ball capture cavity, so that the ball is gently pushed over the lip member, and begins to roll downwards and away from the batter on the initial (delay) ramp. This initial ramp is preferably relatively gently inclined, so that the ball rolls relatively slowly down it. The ball rolls the length of the initial ramp until it contacts the final (acceleration) ramp, where the ball changes direction and rolls down the final ramp towards the front of the apparatus. This final ramp is preferably relatively steeper than the initial ramp, so that the ball attains an appropriate rolling velocity. The ball rolls the length of the final ramp and then rolls up the upwardly-curved launch ramp, leaving the launch ramp in a ballistic trajectory towards the batter's strike zone.

The effect of the combination of these dual ramps (initial and final) is that the ball is delayed in its delivery to the batter for a desired interval, e.g., three to four seconds, which time is analogous to the time it takes for a typical baseball pitcher to wind up and deliver a ball to a batter in a real game. Thus, use of the ball pitching device of that invention replicates a real ball game in that respect. In addition, this time interval gives the batter time to think and properly prepare for the ball (e.g. head down, bat in position), thereby further enhancing the training process.

The ball pitching device of that invention is height-adjustable, enabling the batter to adjust the device to deliver the ball into all areas of the strike zone for batting practice, and adjustable for all height of batters. Furthermore, the device is completely collapsible and portable, enabling its use by individuals in any playing area or park. Finally, because it does not require electric power, the device is safe to be used in all types of weather.

SUMMARY OF THE INVENTION

The pitching device initiator mechanism of this invention provides an improved ball magazine and pitch initiator mechanism for a ball pitching device, such as described in U.S. Pat. No. 4,955,606, designed to selectively pitch a ball to a batter in a "soft-toss" drill, as used to develop a batter's hand, wrist, and eye coordination. The improvement comprises an elongated ball capture cavity portion defining a ball magazine, and having a stop member positioned to capture and stabilize a single ball at a "ready" position. A pitch initiator mechanism comprises a pivotable lever extending beneath the magazine, such that downward movement of one end of the lever extends a ball lifting element on the other end of the lever up into the capture cavity to lift the ball in the ready position over the stop member, to begin its roll down the ramps to the batter.

DETAILED DESCRIPTION OF A PREFERRED EMBODIMENT

Figure 1:
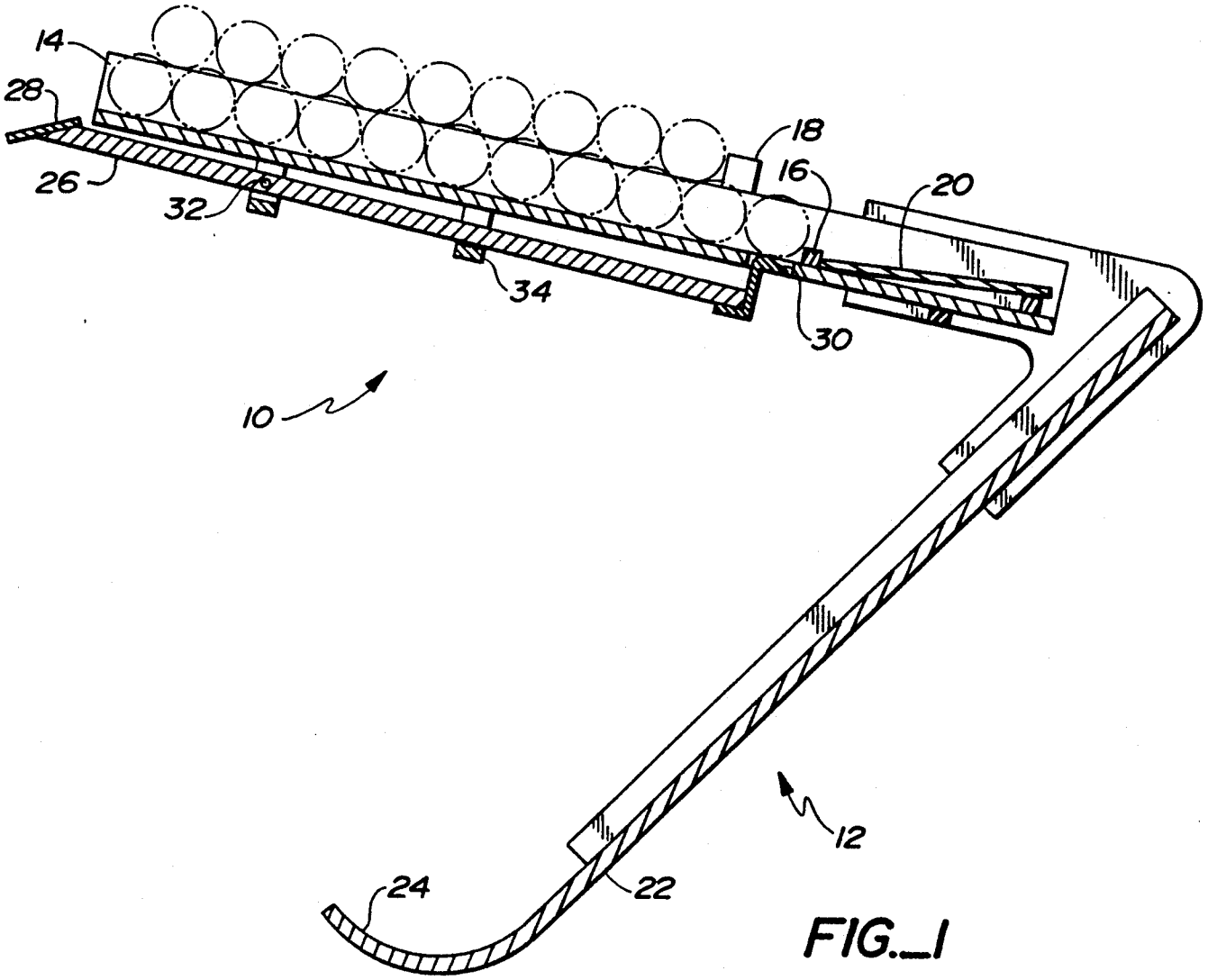
FIG. 1 is a side elevation cross-sectional view of a pitching device initiator mechanism of this invention as installed on a ball pitching device, illustrating a ball capture cavity/magazine, a capture cavity stop member, a ball guide, an initial or delay ramp, a final or acceleration ramp, a launch ramp, and an initiator mechanism comprising lever having a plate end and a ball lifting element end, a fulcrum, and a lever support.

FIG. 1 is a side elevation cross-sectional view of a pitching device initiator mechanism 10 of this invention as installed on a ball pitching device 12, illustrating a ball capture cavity/magazine 14, a capture cavity stop member 16, a ball guide 18, an initial or delay ramp 20, a final or acceleration ramp 22, a launch ramp 24, and an initiator mechanism comprising lever 26 having a plate end 28 and a ball lifting element end 30, a fulcrum 32, and a lever support 34. Magazine 14 can be made in any appropriate size to accommodate a desired quantity of balls. Ball guide 18 is designed to urge balls stacked in the magazine into proper alignment for capture by stop member 16. Lever support 34 may be used to limit the downward extension of ball lifting element 30. The entire apparatus is supported at an appropriate height by an adjustable-height stand, as described in the U.S. Pat. No. 4,955,606.

Figure 2:
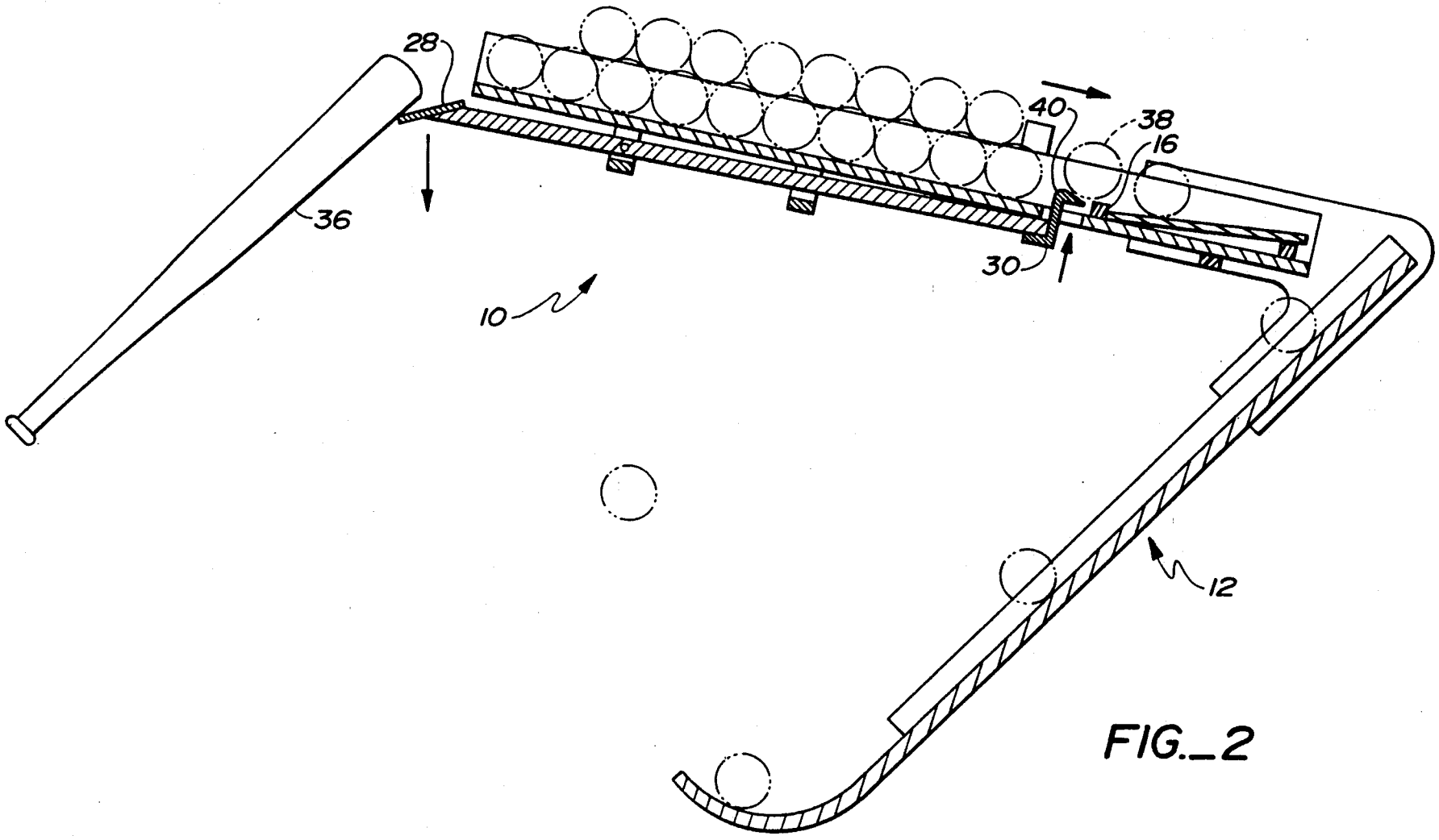
FIG. 2 is a side elevation cross-sectional view of a pitching device initiator mechanism of this invention as installed on a ball pitching device, illustrating a baseball bat having contacted the lever plate end to move the ball lifting element end into the capture cavity to lift the ball over the stop member and initiate the ball's roll down the ramps and to the batter.

FIG. 2 is a side elevation cross-sectional view of a pitching device initiator mechanism 10 of this invention as installed on a ball pitching device 12, illustrating a baseball bat 36 having contacted the lever plate end 28 to move the ball lifting element end 30 into the capture cavity to lift a ball 38 over the stop member 16 and initiate the ball's roll down the ramps and to the batter. Ball lifting element 30 preferably includes an abrupt step 40 to prevent the next ball in the magazine from being prematurely lifted over the stop member.

Figure 3:
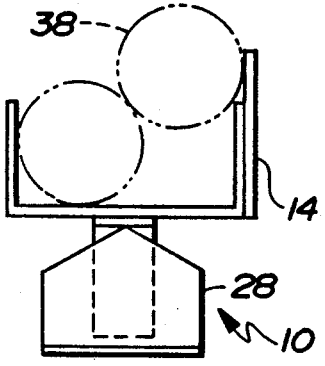
FIG. 3 is an end elevation view of the pitching device initiator mechanism of this invention, illustrating a stacking arrangement of balls (shown in phantom lines) within the magazine, and the lever plate disposed beneath the magazine.

FIG. 3 is an end elevation view of the pitching device initiator mechanism 10 of this invention, illustrating a stacking arrangement of balls 38 (shown in phantom lines) within the magazine 14, and the lever plate 28 disposed beneath the magazine.

While this invention has been described in connection with preferred embodiments thereof, it is obvious that modifications and changes therein may be made by those skilled in the art to which it pertains without departing from the spirit and scope of the invention. For example, the device could be constructed of wood, metal, or any suitable material. Furthermore, the ramps do not have to be linear, but could be curved, as long as they together provide the desired attributes of control and durational delay. Accordingly, the scope of this invention is to be limited only by the appended claims.

What is claimed as invention is:

1. An initiator mechanism for a ball pitching device, said ball pitching device including a ramp portion to deliver a ball to a batter, said initiator mechanism comprising:

a ball capture cavity portion attached to said ramp portion, said ball capture cavity portion bearing a stationary stop member, said stationary stop member positioned to capture and temporarily stabilize a single ball placed in said ball capture cavity portion; and a pivotable lever portion mounted beneath said ball capture cavity portion, said pivotable lever portion having a first end, a fulcrum, and a second end, said second end bearing a ball lifting element disposed adjacent said ball capture cavity portion stationary stop member, wherein when said pivotable lever portion first end is moved downwards, said pivotable lever portion moves about said fulcrum to extend said ball lifting element into said ball capture cavity portion to lift said ball over said ball capture cavity portion stationary stop member.

2. The initiator mechanism for a ball pitching device of claim 1 wherein said ball capture cavity portion is elongated to form a ball magazine to accommodate a plurality of balls.

3. The initiator mechanism for a ball pitching device of claim 2 wherein said pivotable lever portion first end is disposed beneath said ball magazine.

4. The initiator mechanism for a ball pitching device of claim 2 wherein said pivotable lever portion ball lifting element includes a step portion to prevent a ball in said ball magazine from being prematurely lifted over said stationary stop member.

5. The initiator mechanism for a ball pitching device of claim 1 wherein said pivotable lever portion includes a lever support member to limit the travel of said ball lifting element.

6. The initiator mechanism for a ball pitching device of claim 1 wherein said ball capture cavity portion includes a ball guide to urge a ball into proper alignment for capture by said stationary stop member.

* * * * *